United States Patent [19]

Cherian

[11] 4,015,103

[45] Mar. 29, 1977

[54] FUSER CONVEYOR BELT

[75] Inventor: Abraham Cherian, Webster, N.Y.

[73] Assignee: Xerox Corporation, Stamford, Conn.

[22] Filed: Feb. 19, 1975

[21] Appl. No.: 551,213

[52] U.S. Cl. ..... 219/216; 74/231 P; 198/820; 198/844; 219/388; 432/59; 432/227

[51] Int. Cl.[2] ..... H05B 1/00; G03G 15/20

[58] Field of Search ..... 219/216, 388; 355/3 R; 432/59, 227; 198/193, DIG. 7; 74/231 P, 231 R, 231 S

[56] References Cited

UNITED STATES PATENTS

| | | | |
|---|---|---|---|
| 2,401,260 | 5/1946 | Lord et al. | 74/231 R |
| 3,621,727 | 11/1971 | Cicognani | 74/231 P X |
| 3,781,516 | 12/1973 | Tsilibes et al. | 219/216 |

FOREIGN PATENTS OR APPLICATIONS

| | | | |
|---|---|---|---|
| 782,195 | 9/1957 | United Kingdom | 74/231 |

*Primary Examiner*—C. L. Albritton

[57] ABSTRACT

An apparatus in which a powder pattern formed on a sheet of support material is permanently affixed thereto. The sheet of support material is advanced along a path of movement by a conveyor belt. As the sheet advances, the powder pattern thereon is heated. The belt is extended when positioned in the drive system to form a normal force therebetween. This normal force and associate coefficient of friction develops a frictional force minimizing relative movement or slippage therebetween.

2 Claims, 5 Drawing Figures

FUSER CONVEYOR BELT

BACKGROUND OF THE INVENTION

This invention relates generally to an electrophotographic printing machine, and more particularly concerns an apparatus for permanently affixing a powder pattern to a sheet of support material.

Electrophotographic printing records an electrostatic latent image of an original document on a photoconductive member by exposing the charged portion of the photoconductive member to a light image of the original document. A development system moves a developer mix of carrier granules and toner particles into contact with the latent image. The toner particles are attracted electrostatically to the latent image forming a toner powder image thereon. This toner powder image is, then, transferred to the sheet of support material.

Multi-color printing repeats the foregoing processes a plurality of times. However, each development cycle deposits differently colored toner particles onto the sheet of support material. These toner particles are transferred, in superimposed registration with one another, creating a colored copy corresponding to the original document. The fusing operation permanently affixes the multi-layered toner powder image to the sheet of support material. In addition to permanently affixing the toner powder image, the fusing powder image must also form transparent layers to appropriately modulate the light rays transmitted therethrough so that the copy has the composite colors of the original document.

Numerous types of fusing devices have heretofore been developed. In particular, multi-color electrophotographic printing machines have employed fusing devices which heat the conveyor belt transporting the sheet of support material so as to raise the temperature thereof and minimize heat loss thereto. In addition to heating the conveyor belt, a radiant energy source furnishes heat energy to the toner particles. This permanently affixes the toner particles to the sheet of support material and produces transparent colored layers attenuating the light rays passing therethrough to form a color copy of the original document. U.S. Pat. No. 3,781,516 issued to Tsilibes, et al. describes a control system for the foregoing type of fusing apparatus. U.S. Pat. No. 3,826,892 issued to Draugelis, et al. in 1974 and U.S. Pat. No. 3,781,517 issued to Skamara in 1973 also relate to this type of a fusing apparatus. In all of the foregoing patents, a heated conveyor belt advances the sheet of support material, with the toner particles thereon, through the fuser passageway. Under these thermal conditions, the belt frequently relaxes and creeps relative to the support and drive rollers. This reduces the frictional force between the drive rollers and belt introducing relative movement or slippage therebetween. Slippage of this type may result in the support material remaining in the fuser passageway an inordinate length of time resulting in sheet scorching.

Accordingly, it is a primary object of the present invention to improve the fuser conveyor belt so as to prevent slippage between the drive roller and the belt.

SUMMARY OF THE INVENTION

Briefly stated, and in accordance with the present invention, there is provided an apparatus for affixing permanently a powder pattern to a sheet of support material.

Pursuant to the features of the prevent invention, a resilient conveyor belt transports the sheet of support material along a path of movement. The belt is extendable in a direction parallel to the path of movement of the sheet of support material. Means are provided for moving and extending the belt. This creates a normal force between the belt and moving means so as to maintain a frictional force therebetween preventing relative movement. Heating means raise the temperature of the belt, thereby heating the surface of the sheet of support material in contact therewith. A radiant energy source, in thermal communication with the sheet of support material, heats the powder pattern. In this way, the powder pattern is permanently affixed to the sheet of support material.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
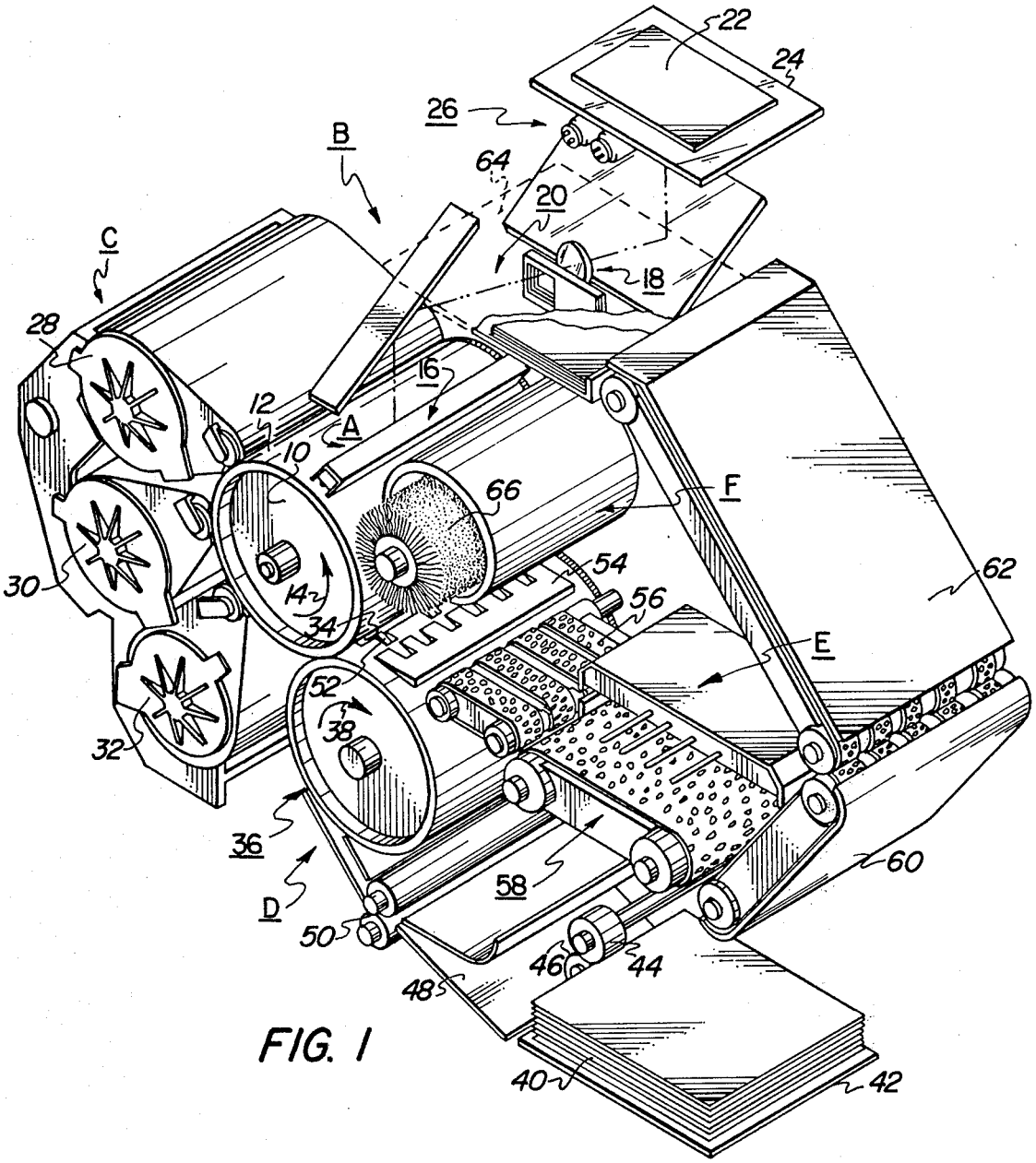
FIG. 1 is a schematic perspective view of an electrophotographic printing machine having the features of the present invention therein.

With continued reference to the drawings, FIG. 1 schematically illustrates an electrophotographic printing machine for producing color copies from a colored original. In the drawings, like reference numerals have been used throughout to designate like elements. Although the present invention is particularly well adapted for use in a fusing apparatus, it should become evident from the following discussion that it is equally well suited for use in other conveyor belt systems and it is not necessarily limited to the particular embodiment shown herein.

As shown in FIG. 1, the electrophotographic printing machine employs a photoconductive member having a rotatably mounted drum 10 with photoconductive surface 12 secured thereto and entrained thereabout. Drum 10 rotates in the direction of arrow 14 and moves photoconductive surface 12 through a series of processing stations disposed about the periphery thereof. One type of suitable polychromatic photoconductive material is disclosed in U.S. Pat. No. 3,655,377 issued to Sechak in 1972. In general, a suitable photoconductive material comprises an aluminum substrate having a selenium layer adhering thereto. The machine operations at each processing station are coordinated to produce the proper sequence of events for multi-color copying.

As drum 10 rotates in the direction of arrow 14, photoconductive surface 12 initially passes through charging station A. A corona generating device, indicated generally by the reference numeral 16, is positioned at charging station A. Corona generating device 16 extends in a longitudinal direction transversely across photoconductive surface 12. A suitable corona generating device is described in U.S. Pat. No. 2,778,946 issued to Mayo in 1957. Corona generating device 16 produces a spray of ions for charging photoconductive surface 12 to a relatively high substantially uniform potential.

After photoconductive surface 12 is charged to a substantially uniform potential, it rotates to exposure station B. Exposure station B includes a moving lens system, indicated generally by the reference numeral 18, and a color filter mechanism, depicted generally by the numeral 20. One type of drive mechanism for a moving lens system suitable for electrophotographic printing is described in U.S. Pat. No. 2,062,108 issued to Mayo in 1962. As shown in FIG. 1, a colored original document 22 is stationarily supported face down upon transparent viewing platen 24. As lamps 26 move across original document 22, successive incremental areas thereof are illuminated. Lamps 26 and lens 18 move in a timed relationship with drum 10 to project a flowing light image of original document 22 onto the charged portion of photoconductive surface 12. This light image selectively discharges photoconductive surface 12 recording an electrostatic latent image thereon. Filter 20 interposes selected colored filters into the optical light path. Thus, the filter of filter mechanism 20 operates on the light rays transmitted through lens 18 recording an electrostatic latent image on photoconductive surface 12 corresponding to a pre-selected spectral region of the electromagnetic wave spectrum, i.e. a color separated electrostatic latent image. This electrostatic latent image corresponds to a single color of original document 22.

Thereafter, drum 10 rotates that portion of photoconductive surface 12 having the single color electrostatic latent image recorded thereon to development station C. Development station C includes three individual developer units, generally indicated by the reference numerals 28, 30 and 32, respectively. Each developer unit depicted in FIG. 1 is a magnetic brush-type of developer unit. In such a system, a magnetizable developer mix having carrier granules and toner particles is continually brought through a directional flux field forming a brush therefrom. The portion of photoconductive surface 12 having the electrostatic latent image thereon is contacted by the brush of developer mix. In this way, the toner particles are attracted from the carrier granules to the latent image rendering it visible. Developer units 28, 30 and 32, each apply toner particles corresponding to the compliment of the color separated latent images recorded on photoconductive surface 12. By way of example, developer unit 28 deposits cyan toner particles on a red filtered latent image, developer unit 30 deposits magenta toner particles on a green filtered latent image, and developer unit 32 deposits yellow toner particles on a blue filtered latent image.

The toner powder image formed on photoconductive surface 12 of drum 10 is then advanced to transfer station D. At transfer station D, the powder image is transferred to a sheet support material 34. Support material 34 is secured to an electrically biased transfer roller, shown generally at 36. Transfer roll 36 recirculates support material 34 so that successive toner powder images deposited on photoconductive surface 12 may be transferred thereto in superimposed registration with one another. Transfer roll 36 rotates in the direction of arrow 38 at substantially the same angular velocity as drum 10. Inasmuch as transfer roll 36 and drum 10 are of the same diameter, image registration is maintained. The electrical bias applied to transfer roll 36 is of the proper magnitude and polarity to attract electrostatically the toner powder image from photoconductive surface 12 to support material 34.

Prior to proceeding with remaining processing stations, the sheet feeding path will be briefly described. Support material 34 is advanced from stack 40 positioned on tray 42. This is accomplished by a sheet feed mechanism comprising feed roll 44 operatively associated with retard roll 46. Feed roll 44 advances the sheet of support material into chute 48. Chute 48 guides the sheet into the nip between register rolls 50. Register rolls 50 align and advance the sheet to gripper fingers 52 mounted in transfer roll 36. Gripper fingers 52 secure support material 34 to transfer roll 36. After the requisite number of toner powder images have been transferred thereto, gripper fingers 52 space support material 34 from transfer roll 36. As transfer roll 36 continues to rotate, stripper bar 54 is interposed between support material 34 and transfer roll 36. In this way, support material 34 is separated from transfer roll 36.

Conveyor belt 56 advances support material 34 to fixing station E. At fixing station E, a fuser designated by the reference numeral 58, applies sufficient heat to permanently affix the toner powder image to support material 34. Fuser 38 will be discussed hereinafter in greater detail with reference to FIGS. 2 through 5, inclusive. After the multi-layered toner powder image is permanently secured to the support material 34, endless belt conveyors 60 and 62 advance support material 34 to catch tray 64. At catch tray 64, the machine operator removes the completed copy.

Returning now to the various processing stations, cleaning station F is located after transfer station D. A rotatably mounted fibrous brush 66 is located at cleaning station F contacting photoconductive surface 12. Prior thereto, a corona generating device (not shown) discharges the charge remaining on photoconductive surface 12 and the residual toner particles. Thereafter, brush 66 removes the discharged residual toner particles from photoconductive surface 12. Fibrous brush 66 may be of the type described in U.S. Pat. No. 3,590,412 issued to Gerbasi in 1971.

It is believed that the foregoing description is sufficient for purposes of the present application to depict the general operation of an electrophotographic printing machine employing the features of the present invention therein.

Figure 2:
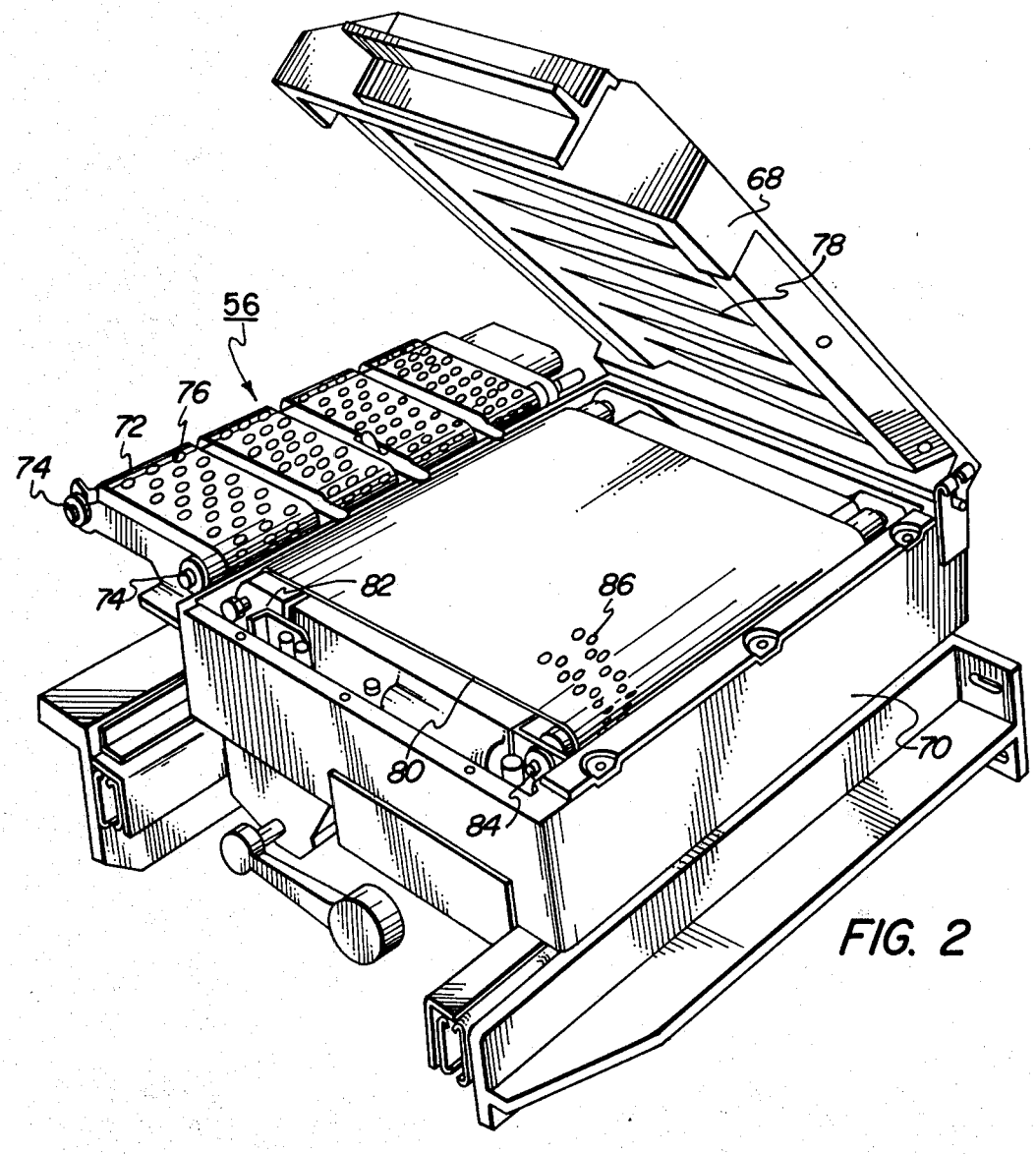
FIG. 2 is a perspective view of the fuser used in the FIG. 1 printing machine.

Referring now to the specific subject matter of the present invention, FIG. 2 depicts fuser 58 more clearly. This type of fusing device is described in U.S. Pat. No. 3,781,517 issued to Skamara in 1973, as well as U.S. Pat. No. 3,826,892 issued to Draugelis, et al. in 1974 and U.S. Pat. No. 3,781,516 issued Tsilibes, et al. in 1973, the relevant portions of the foregoing patents being hereby incorporated into the present application.

As depicted in FIG. 2, fusing device 58 includes a cover member 68 and a lower housing member 70. Conveyor belt 56 transports support material 34 from transfer roll 36 to fusing device 58. Conveyor belt 56 includes a plurality of endless belts 72 entrained about a pair of opposed spaced rollers 74. A vacuum system maintains a low pressure by drawing air through apertures 76 in belts 72 to tack support material 34 thereto.

Cover 68 has a radiant energy source or heat strips 78 preferably made from a nickel chromium alloy ribbon and entrained helically about a pair of opposed, spaced ceramic spools. Heat strips 78 are configured to provide substantially uniform radiation, the end elements thereof being arranged to minimize radiation falloff. A pair of reflectors are interposed between heat strips 78 and the outer shell of cover 68. The reflectors are, preferably, made from aluminum, being secured to the insulation disposed on the outer shell of cover 68. Lower housing 70 defines an open ended chamber having conveyor belt 80 entrained about a pair of opposed spaced rollers 82 and 84. Rollers 82 and 84 are mounted rotatably on the frame of the fusing device. Endless conveyor belt 80 has a plurality of apertures 86 therein. Belt 80 is entrained about spaced rollers 82 and 84. Air is drawn through apertures 86 of belt 80 so as to tack support material 34 thereto as it passes through a fusing device 58. Conveyor belt 80 will be described hereinafter in greater detail with reference to FIGS. 4 and 5.

Figure 3:
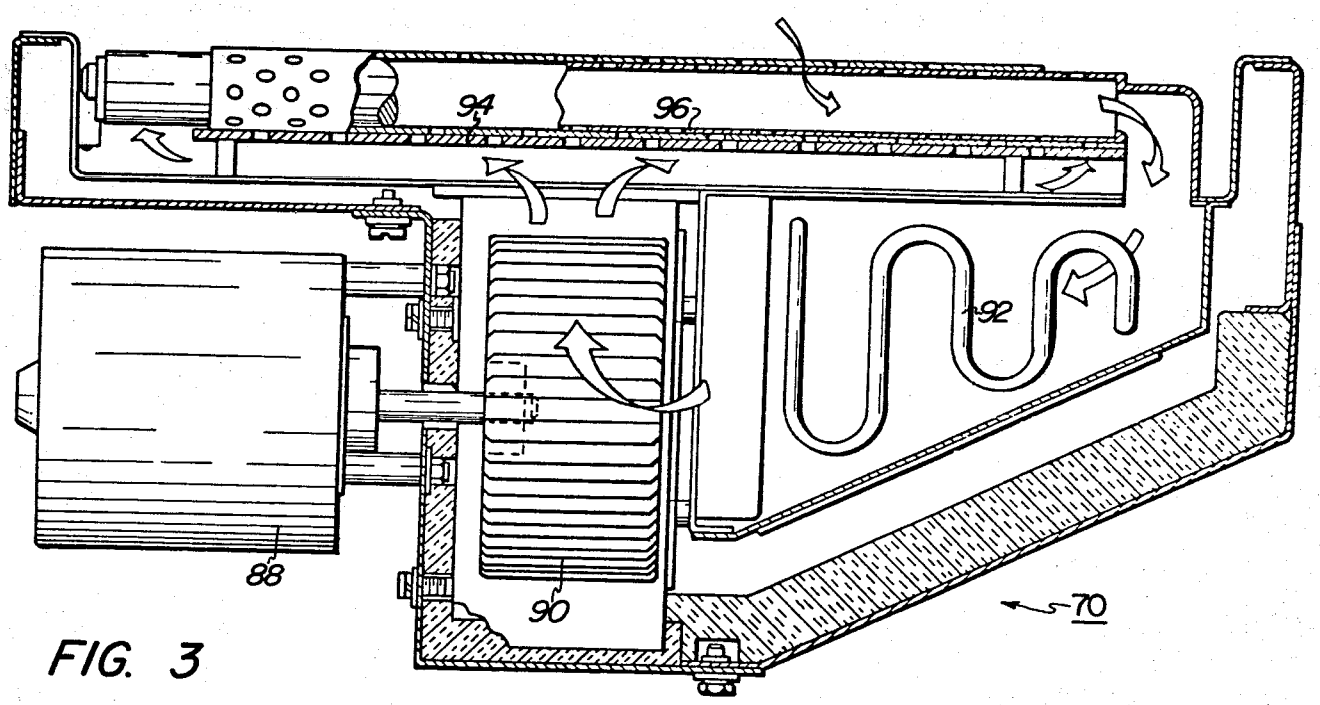
FIG. 3 is a sectional elevational view of the FIG. 2 fuser.

Referring now to FIG. 3, there is shown a sectional view of lower housing 70. As shown therein, blower motor 88 rotates vaned member 90 to draw air through resistance heating element 92. Air is drawn into vaned member 90 and out therefrom onto plate 94. In this way, cool air is heated as it passes over resistance heating element 92 into vaned member 90 and out therefrom onto plate 94 raising the temperature thereof. Plate 94 contacts interior surface 96 of belt 80. This raises the temperature of belt 80. Belt 80, in turn, contacts support material 34, and in this manner, raises the temperature thereof. Preferably, heating element 92 is a 800 watt tubular high mass heater.

Figure 4:
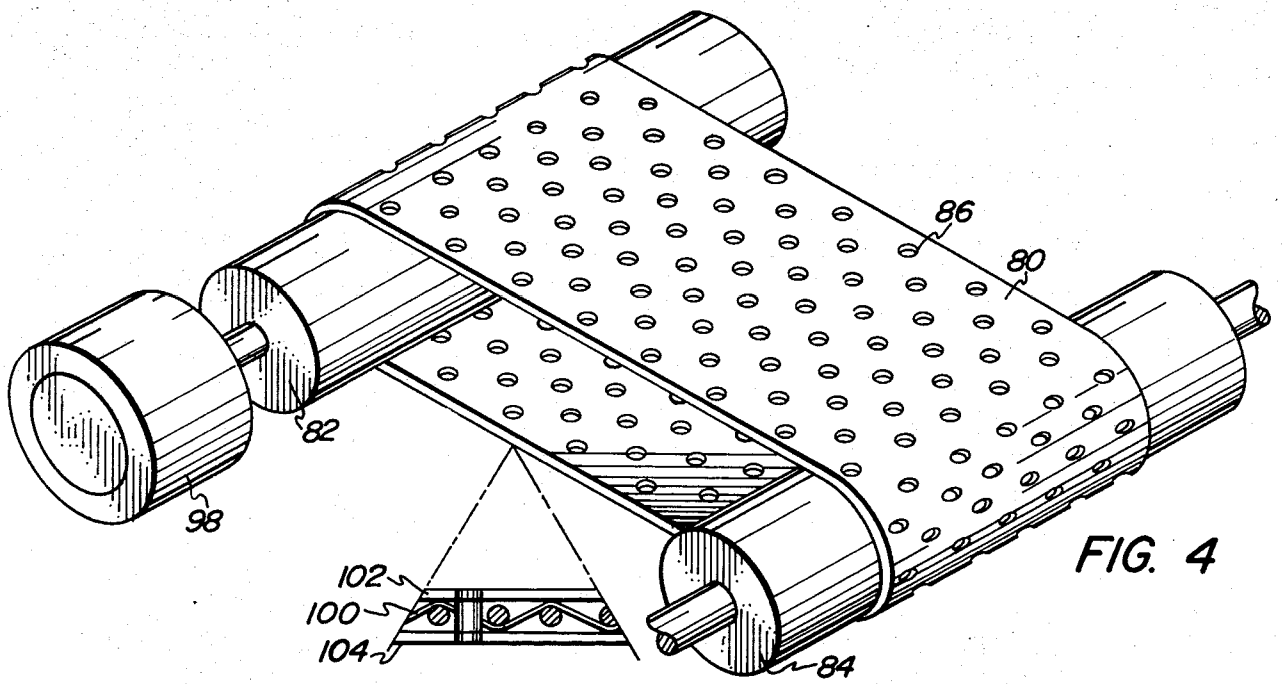
FIG. 4 is a perspective view of the conveyor belt system employed in the FIG. 2 fuser.

Referring now to FIG. 4, there is shown the detailed structural arrangement of conveyor belt 80 and rollers 82 and 84, respectively. Motor 98 is adapted to drive roller 82 so as to advance conveyor belt 80. In this way, conveyor belt 80 moves the sheet of support material through the fusing apparatus. Belt 80 is extended when it is positioned over rollers 82 and 84. In the free state or unextended condition, the distance between rollers 82 and 84 is greater than the free length of endless belt 80. Endless belt 80 is stretched to fit over rollers 82 and 84, i.e. entrained thereabout. To that end, endless belt 80 must be made from a resilient material. As shown in FIG. 4, a plurality of apertures 86 are located in belt 80. Rollers 82 and 84 are crowned rollers and stretching belt 80 thereover produces a normal force thereon. This normal force insures that drive roller 82 frictionally advances belt 80 with no slippage therebetween. It should be noted that this resilient normal force remains sufficient under all operating conditions to insure that drive roller 82 frictionally advances belt 80 through the fuser passageway with no slippage therebetween. This is highly significant in that it prevents the sheet of support material from being heated excessively and scorched i.e. by remaining for too long a duration in the fuser. The specific structure of belt 80 is shown in FIG. 4.

As depicted in FIG. 4, belt 80 comprises a fabric 100 woven from glass fibers interposed between two layers of elastomeric material 102 and 104. Preferably, the elastomeric layers 102 and 104 are made from a silicone rubber. Glass fabric layer 100 is corregated in the lengthwise direction so that in the extended condition, i.e. when positioned over rollers 82 and 84, it exerts a resilient or spring force producing a normal force on rollers 82 and 84. The glass fabric is arranged in a zig-zag pattern. Preferably, silicone layers 102 and 104 are made by the Connecticut Hard Rubber Company from Compound No. 808. Similarly, glass fiber layer 100 is made by Connecticut Hard Rubber Company and is coated fabric No. 4050. The essential criteria is that the glass fibers must be corregated or arranged in a zig-zag pattern so as to have the requisite resiliency insuring that a normal force is exerted between the belt and rollers. This insures that a normal force is exerted between the belt and roller maintaining a frictional force and preventing relative movement therebetween. It is essential that the rollers and belt rotate in synchronism with one another. Belts heretofore utilized would relax under the extreme heat conditions in fusing device 58 resulting in slippage between the rollers and belt. More particularly, extensive creep occurred at 450° in these prior art types of belts.

Figure 5:
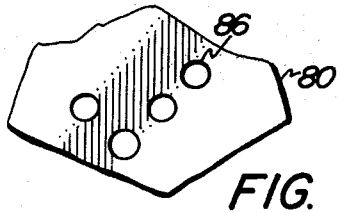
FIG. 5 is a fragmentary plan view of the FIG. 4 conveyor belt depicting the hole pattern therein.

Referring now to FIG. 5, there is shown the hole pattern in belt 80. Belt 80 includes a plurality of apertures or hole, 86 arranged in parallel rows. Each row has the holes 86 staggered or arranged in a zig-zag pattern.

In recapitulation, the fusing apparatus of the present invention employs a resilient conveyor belt extended in a direction substantially parallel to the path of movement of the sheet of support material. The belt is resiliently entrained about a pair of opposed, spaced rollers and exerts a normal force therebetween. This normal force insures that, under the severe conditions of heat in the fusing device, a frictional force is maintained between the drive roller and conveyor belt minimizing slippage therebetween. Conveyor belt slippage could cause the support material to remain in the fusing device an excessive duration of time resulting in sheet scorching.

Thus, it is apparent that there has been provided in the fusing apparatus of the prevent invention, an improved conveyor belt. The present invention fully satisfies the objects, aims and advantages hereinbefore set forth. While this invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An apparatus for affixing permanently a powder pattern to a sheet of support material, including:

a resilient conveyor belt for transporting the sheet of support material with the powder pattern deposited on one surface thereof along a path of movement, said belt having a corrugated surface, allowing it to be extendable in a direction substantially parallel to the path of movement of the sheet of support.

means for moving and resiliently extending said belt so as to create a normal force thereon to maintain a frictional force between said belt and said moving means preventing relative movement therebetween;

means for heating said belt so as to raise the temperature of the surface of the sheet of support material in contact therewith; and a radiant energy source in thermal communication with the sheet of support material so as to heat, and, thereby, permanently affix the powder pattern to the sheet of support material; and said belt including a first layer of glass fibers woven to create a fabric having, in the unextended condition, a corrugation therein in a direction substantially parallel to the path of movement of the sheet of support material; and at least a pair of layers of elastomeric material having said first layer interposed therebetween and secured thereto.

2. An electrophotographic printing machine of the type having a powder pattern formed on a sheet of support material, wherein the improvement includes:

a resilient conveyor belt for transporting the sheet of support material with the powder pattern deposited on one surface thereof along a path of movement, said belt being corrugated and extendable in a direction substantially parallel to the path of movement of the sheet of support material;

means for moving and resiliently extending said belt so as to create a normal force thereon to maintain a frictional force between said belt and said moving means preventing a relative movement therebetween;

means for heating said belt so as to raise the temperature of the surface of the sheet of support material in contact therewith; and a radiant energy source in thermal communication with the sheet of support material so as to heat, and, thereby, permanently affix the powder pattern to the sheet of support material; and a first layer of glass fibers woven to create a fabric having, in the unextended condition, a corrugation therein in a direction substantially parallel to the path of movement of the support material, and having in the extended condition, a corrugation therein in a direction substantially perpendicular to the path of movement of the support material; and at least a pair of layers of elastomeric material having said first layer interposed therebetween and secured thereto.

* * * * *